US011510479B2

(12) United States Patent
Sasaki et al.

(10) Patent No.: US 11,510,479 B2
(45) Date of Patent: Nov. 29, 2022

(54) ROD-SHAPED COSMETIC MATERIAL FEEDING CONTAINER

(71) Applicant: TOKIWA CORPORATION, Kawaguchi (JP)

(72) Inventors: Arata Sasaki, Kawaguchi (JP); Akira Haruyama, Kawaguchi (JP)

(73) Assignee: TOKIWA CORPORATION, Kawaguchi (JP)

( * ) Notice: Subject to any disclaimer, the term of this patent is extended or adjusted under 35 U.S.C. 154(b) by 0 days.

(21) Appl. No.: 17/408,144

(22) Filed: Aug. 20, 2021

(65) Prior Publication Data

US 2022/0079321 A1 Mar. 17, 2022

(30) Foreign Application Priority Data

Aug. 21, 2020 (JP) ..... JP2020-140198

(51) Int. Cl.
*A45D 40/06* (2006.01)
*A45D 40/20* (2006.01)

(52) U.S. Cl.
CPC ..... *A45D 40/06* (2013.01); *A45D 40/20* (2013.01); *A45D 2040/208* (2013.01); *A45D 2200/1072* (2013.01)

(58) Field of Classification Search
CPC ..... A45D 40/00; A45D 40/04; A45D 40/10; A45D 40/16; A45D 40/20; A45D 40/205; A45D 2040/00; A45D 2040/0025; A45D 2040/10; A45D 2040/105; A45D 2040/20; B65D 83/0005; B65D 83/0011; B65D 83/0027; B65D 83/0038
USPC ..... 401/68, 75, 79, 81, 87, 171–174
See application file for complete search history.

(56) References Cited

U.S. PATENT DOCUMENTS 5,765,955 A * 6/1998 Tani ..... A45D 40/04 401/75
7,736,079 B2 * 6/2010 Tani ..... B43K 24/06 401/75
8,562,232 B2 * 10/2013 Ishida ..... A45D 40/04 401/75
9,788,635 B2 * 10/2017 Tani ..... A45D 40/20

FOREIGN PATENT DOCUMENTS

JP H03-008191 Y2 2/1991

* cited by examiner

*Primary Examiner* — David J Walczak
(74) *Attorney, Agent, or Firm* — Procopio, Cory, Hargreaves & Savitch LLP

(57) ABSTRACT

A rod-shaped cosmetic material feeding container includes a sleeve that is capable of accommodating a rod-shaped cosmetic material, a barrel that is engaged with the sleeve so as to be rotatable relative to the sleeve, a screw that is disposed inside the barrel so as to be synchronously rotatable, and a mechanism portion that is accommodated inside the sleeve and the barrel and configured to feed out the rod-shaped cosmetic material. The screw includes a slope and a female screw. The mechanism portion includes a lead holder, an ejection rod, and a propelling rod. The sleeve has an advancing limit reached by the lead holder of the mechanism portion fed out by a screwing action of the female screw and a male screw when the sleeve and the barrel are rotated relative to each other.

7 Claims, 22 Drawing Sheets

ROD-SHAPED COSMETIC MATERIAL FEEDING CONTAINER

CROSS-REFERENCE TO RELATED APPLICATION

This application claims priority from Japanese Patent Applications No. 2020-140198 filed on Aug. 21, 2020, the entire contents of which are incorporated herein by reference.

TECHNICAL FIELD

The present invention relates to a rod-shaped cosmetic material feeding container.

BACKGROUND

In the related art, there has been a rod-shaped cosmetic material feeding container that feeds out a rod-shaped cosmetic material to be used in which the rod-shaped cosmetic material is replaced with, for example, a refill container sold separately for refilling when the rod-shaped cosmetic material is consumed and replaced. In recent years, the refill container has a matter from the viewpoint of waste treatment and protection of global resources, and an ecological container is required.

Only the rod-shaped cosmetic material may be replaced without using the refill container in replacement of the rod-shaped cosmetic material, but removal of the rod-shaped cosmetic material having a small core diameter from a core chuck is complicated, and fingers may become dirty.

In a solid rod-shaped cosmetic material container described in JP-UM-B-3-8191, a screw rod capable of advancing and retreating and a hollow tubular chuck guide advancing and retreating together with the screw rod are lowered to a most end position, a flat plate-shaped core chuck is put on an upper base of the screw rod to vertically stand a shaft tube, a space surrounded by the upper base of the screw rod, the flat plate-shaped core chuck, and the hollow tubular chuck guide is filled with a muddy or kneaded cosmetic material, and the cosmetic material is not only placed on the core chuck, but also enters a back surface of the core chuck through a penetrated hole of the core chuck, and is solidified in this state, and thus the rod-shaped cosmetic material is loaded.

In the solid rod-shaped cosmetic material container, after the rod-shaped cosmetic material protruding from the chuck guide is used up, since only the core chuck advances independently of the chuck guide and the remaining rod-shaped cosmetic material is pushed out and used, the rod-shaped cosmetic material may be used to a full extent, and the rod-shaped cosmetic material and the core chuck are discharged from the solid rod-shaped cosmetic material container by the subsequent advancing of the screw rod.

However, in JP-UM-B-3-8191, although the rod-shaped cosmetic material may be used to the full extent, the rod-shaped cosmetic material cannot be replaced since it is not originally intended to be replaced. Further, since the discharged core chuck is discarded as waste, the matter of environmental protection still remains.

Therefore, an object of the present invention is to provide a rod-shaped cosmetic material feeding container capable of discharging a rod-shaped cosmetic material without dirtying fingers and easily replacing the rod-shaped cosmetic material while protecting the environment without waste such as a refill container at the time of replacement of the rod-shaped cosmetic material.

SUMMARY OF INVENTION

A rod-shaped cosmetic material feeding container in the present invention includes a sleeve that is capable of accommodating a rod-shaped cosmetic material, a barrel that is engaged with the sleeve so as to be rotatable relative to the sleeve, a screw that is provided with a spring portion expanding and contracting in an axial direction, provided with a female screw on an inner periphery on a rear side of the screw in the axial direction of the spring portion, and disposed inside the barrel so as to be synchronously rotatable, and a mechanism portion that is accommodated inside the sleeve and the barrel and configured to feed out the rod-shaped cosmetic material. The mechanism portion includes a lead holder that includes a core gripping portion that is capable of gripping the rod-shaped cosmetic material, and is engaged with the sleeve so as to be synchronously rotatable and movable in the axial direction, an ejection rod that is disposed inside the lead holder, includes a rod-shaped portion that extends forward in the axial direction, and is engaged with the lead holder so as to be synchronously rotatable and movable in the axial direction, a propelling rod that includes a male screw screwed to the female screw on an outer periphery thereof, and is engaged with the ejection rod so as to be synchronously rotatable and immovable in the axial direction, and a compression spring that is disposed between the lead holder and the ejection rod. An advancing limit is provided in the sleeve and reached by the lead holder of the mechanism portion fed out by a screwing action of the female screw and the male screw when the sleeve and the barrel are rotated relative to each other. An engaging portion is provided on the propelling rod and configured to be engaged with the screw so as to be synchronously rotatable when the lead holder reaches the advancing limit. A slope is provided at a rear portion of the screw, against which a protrusion provided inside the barrel abuts, and is pushed forward while compressing the spring portion when the sleeve and the barrel are further relatively rotated in the same direction in a state where the engaging portion of the propelling rod is engaged with the screw so as to be synchronously rotatable. By pushing the slope, the propelling rod and the ejection rod are fed out while compressing the compression spring, and the rod-shaped portion of the ejection rod enters the core gripping portion of the lead holder.

According to the rod-shaped cosmetic material feeding container, the mechanism portion including the lead holder, the ejection rod, the propelling rod, and the compression spring is synchronously rotatable with the sleeve, the barrel and the screw are synchronously rotatable, and when the sleeve and the barrel are relatively rotated, the screwing action of the female screw of the screw and the male screw of the propelling rod is exerted to feed out the mechanism portion. When the lead holder of the mechanism portion reaches the advancing limit, the screw and the propelling rod are engaged with each other so as to be synchronously rotatable, and when the sleeve and the barrel are further rotated relative to each other in the feeding-out direction, the protrusion provided inside the barrel abuts against the slope of the screw, and the slope is pushed forward while compressing the spring portion of the screw, so that the propelling rod and the ejection rod are fed out while compressing the compression spring, and the rod-shaped portion of the ejection rod enters the core gripping portion of the lead holder. Therefore, the remaining rod-shaped cosmetic material gripped by the core gripping portion is pushed out by the rod-shaped portion of the ejection rod, and the rod-shaped cosmetic material can be discharged without dirtying fingers. In addition, a new rod-shaped cosmetic material can be easily loaded. That is, when the rod-shaped cosmetic material is replaced, there is no waste such as a refill container, and the rod-shaped cosmetic material can be easily replaced while the environment is protected. Further, since the compression spring and the spring portion of the screw are disposed in the container, the rod-shaped cosmetic material can be protected from an impact even when the impact is applied to the container.

Here, when the protrusion of the barrel abuts against and moves from a start portion to an end portion of the slope in a state where a length of the ejection rod to be fed out is equal to or greater than a core gripping length in the axial direction of the core gripping portion of the lead holder, the rod-shaped cosmetic material can be surely discharged.

Further, in a state where the rod-shaped cosmetic material feeding container has a configuration that one or a plurality of slopes are provided along the circumferential direction of the screw, the protrusion of the barrel moves to the start portions of the slopes by an urging force of the compression spring and the rod-shaped portion of the ejection rod retreats until the rod-shaped portion exits from the core gripping portion when the abutment of the protrusion of the barrel against the slopes exceeds the end portions of the slopes, the rod-shaped portion of the ejection rod exits from the core gripping portion without relatively rotating the sleeve and the barrel (screw) in a reverse direction. Therefore, the rod-shaped cosmetic material can be pushed into the core grip portion and gripped without any trouble, and the rod-shaped cosmetic can be loaded more easily.

As described above, according to the present invention, it is possible to provide the rod-shaped cosmetic material feeding container capable of easily replacing the rod-shaped cosmetic material while protecting the environment without waste such as the refill container at the time of replacing the rod-shaped cosmetic material, and capable of protecting the rod-shaped cosmetic material from an impact even when the impact is applied to the container.

DETAILED DESCRIPTION OF EMBODIMENTS

Figure 1:
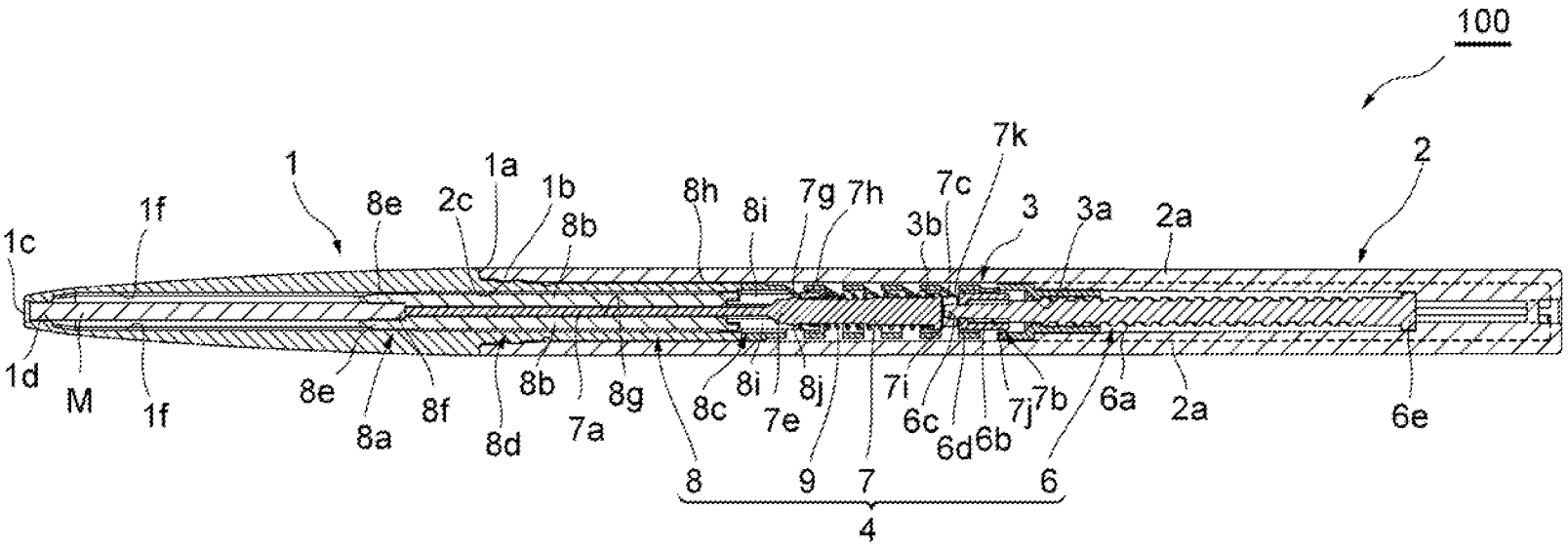
FIG. 1 is a longitudinal cross-sectional view illustrating a rod-shaped cosmetic material feeding container according to an embodiment of the present invention, and is a view illustrating an initial state.
Figure 2:
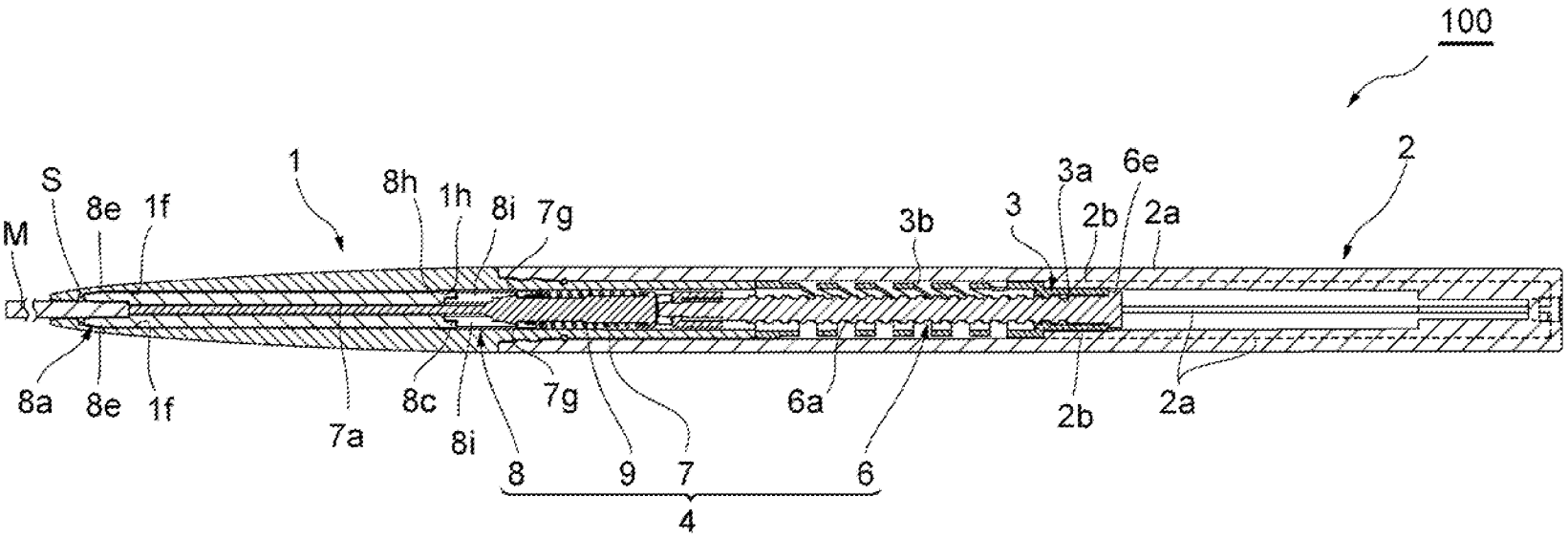
FIG. 2 is a longitudinal cross-sectional view illustrating the rod-shaped cosmetic material feeding container according to the embodiment of the present invention, and is a view illustrating a state in which a lead holder reaches an advancing limit.
Figure 3:
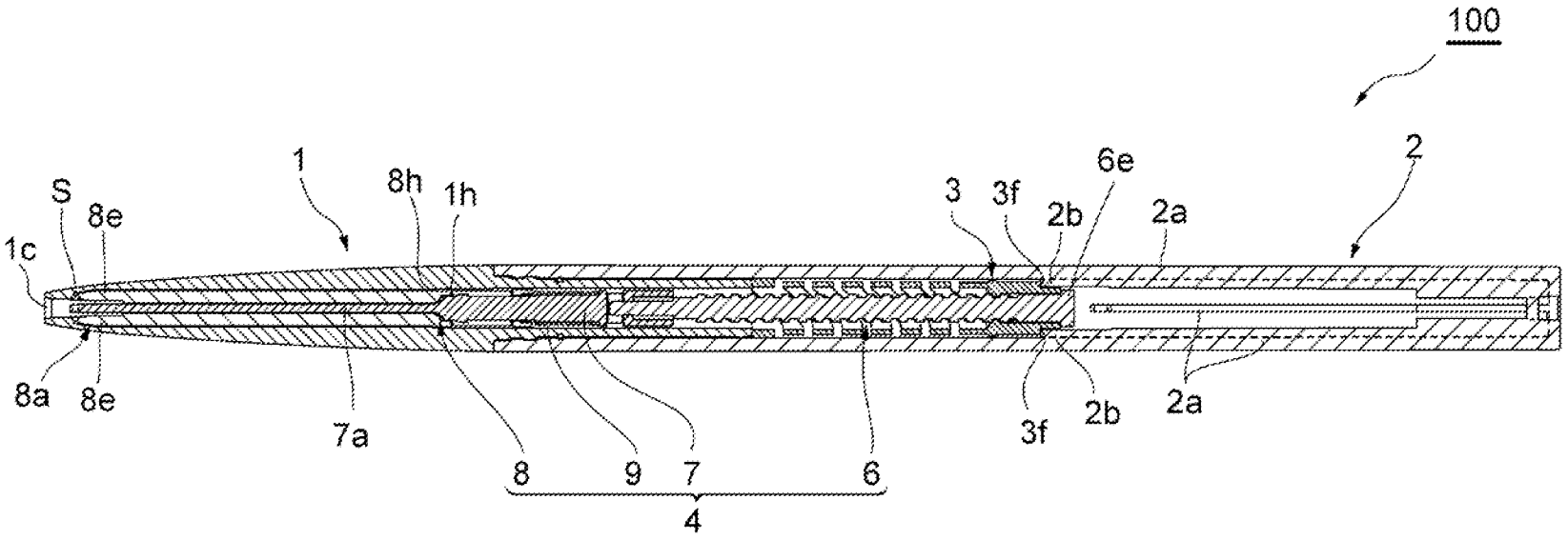
FIG. 3 is a longitudinal cross-sectional view illustrating the rod-shaped cosmetic material feeding container according to the embodiment of the present invention, and is a view illustrating a state in which an ejection rod is fed out to the maximum.
Figure 4:
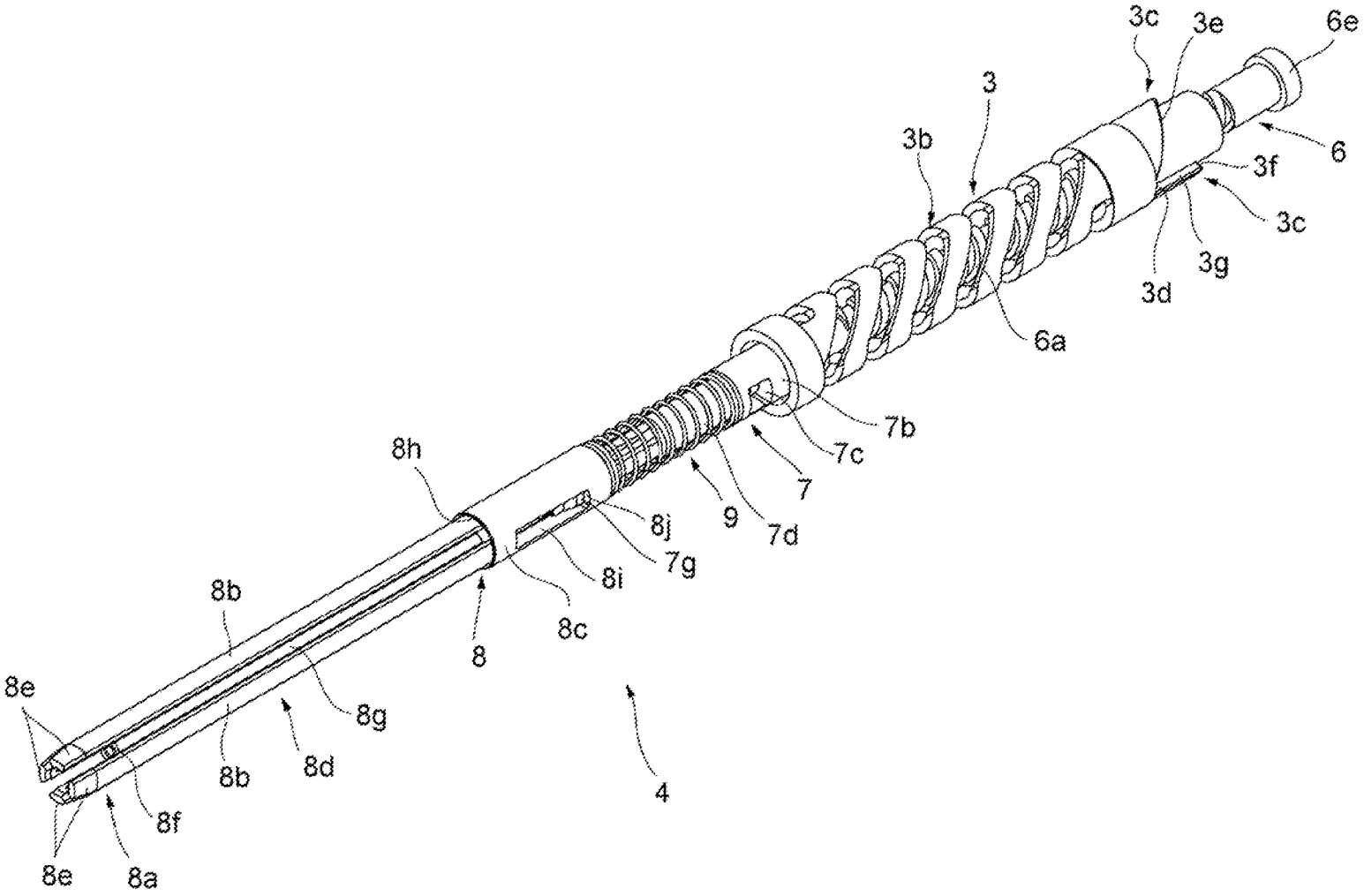
FIG. 4 is a perspective view illustrating an inside of a sleeve and a barrel in FIG. 2.
Figure 6:
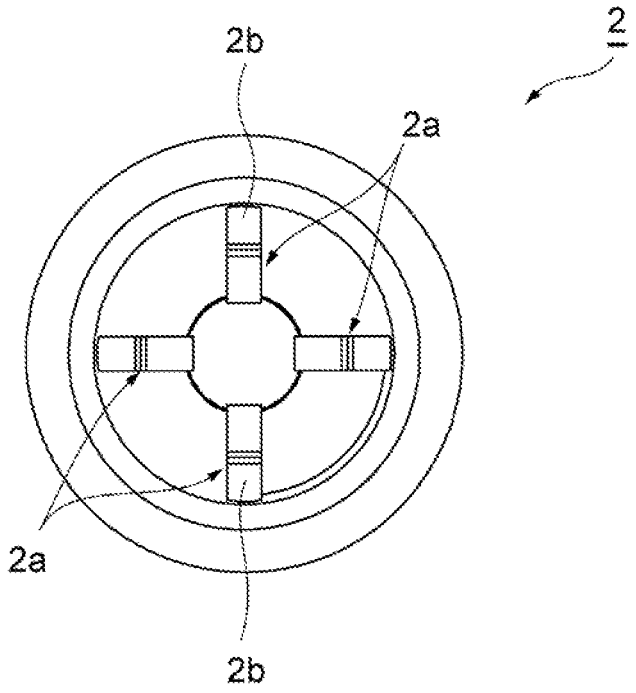
FIG. 6 is a left side view of the barrel illustrated in FIG. 5.
Figure 7:
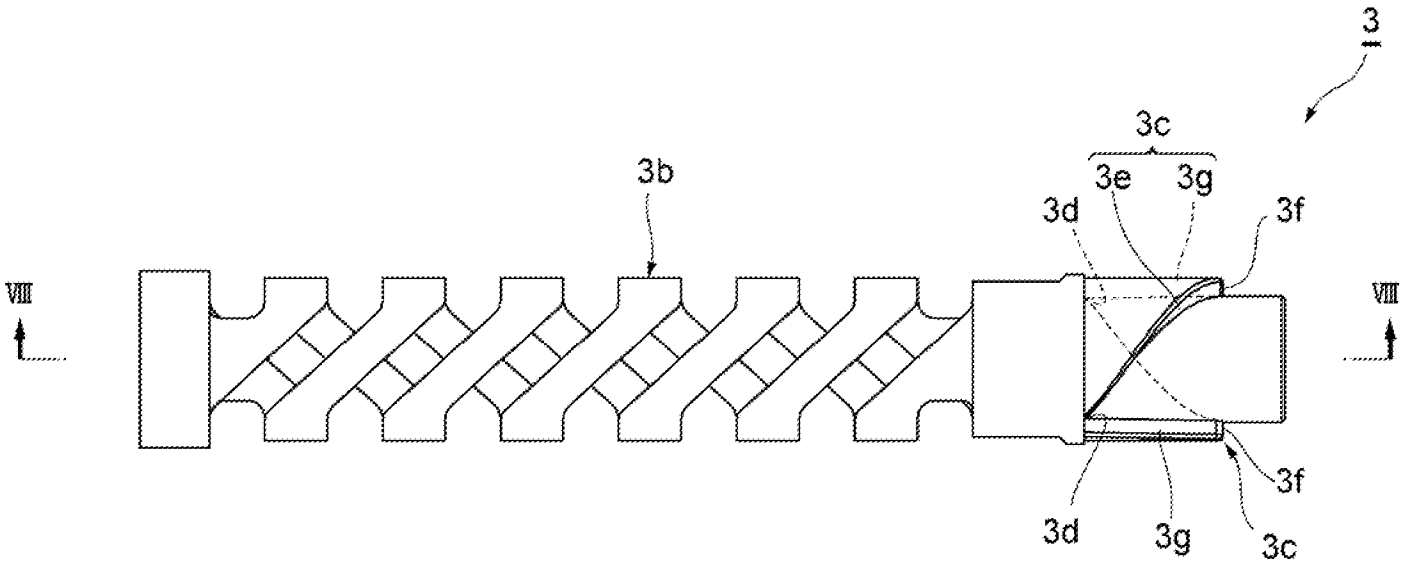
FIG. 7 is a side view illustrating a screw in FIGS. 1 and 4.
Figure 8:
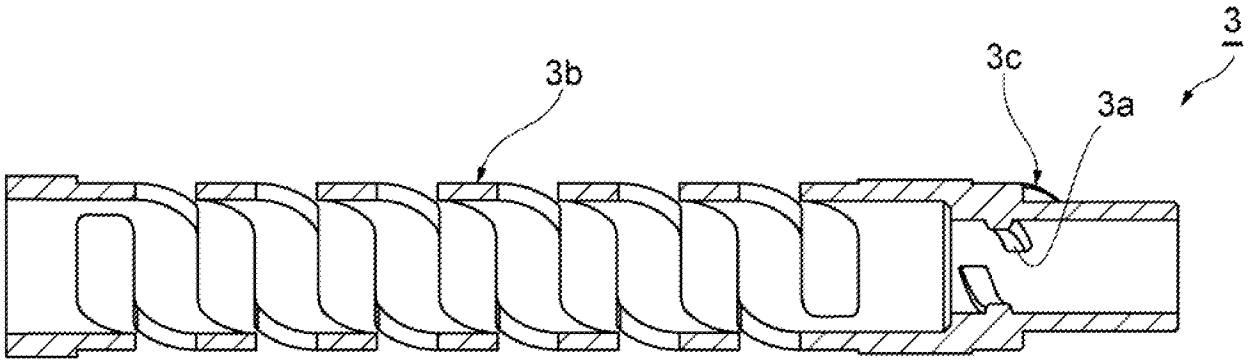
FIG. 8 is a cross-sectional view taken along a line VIII-VIII in FIG. 7.
Figure 9:
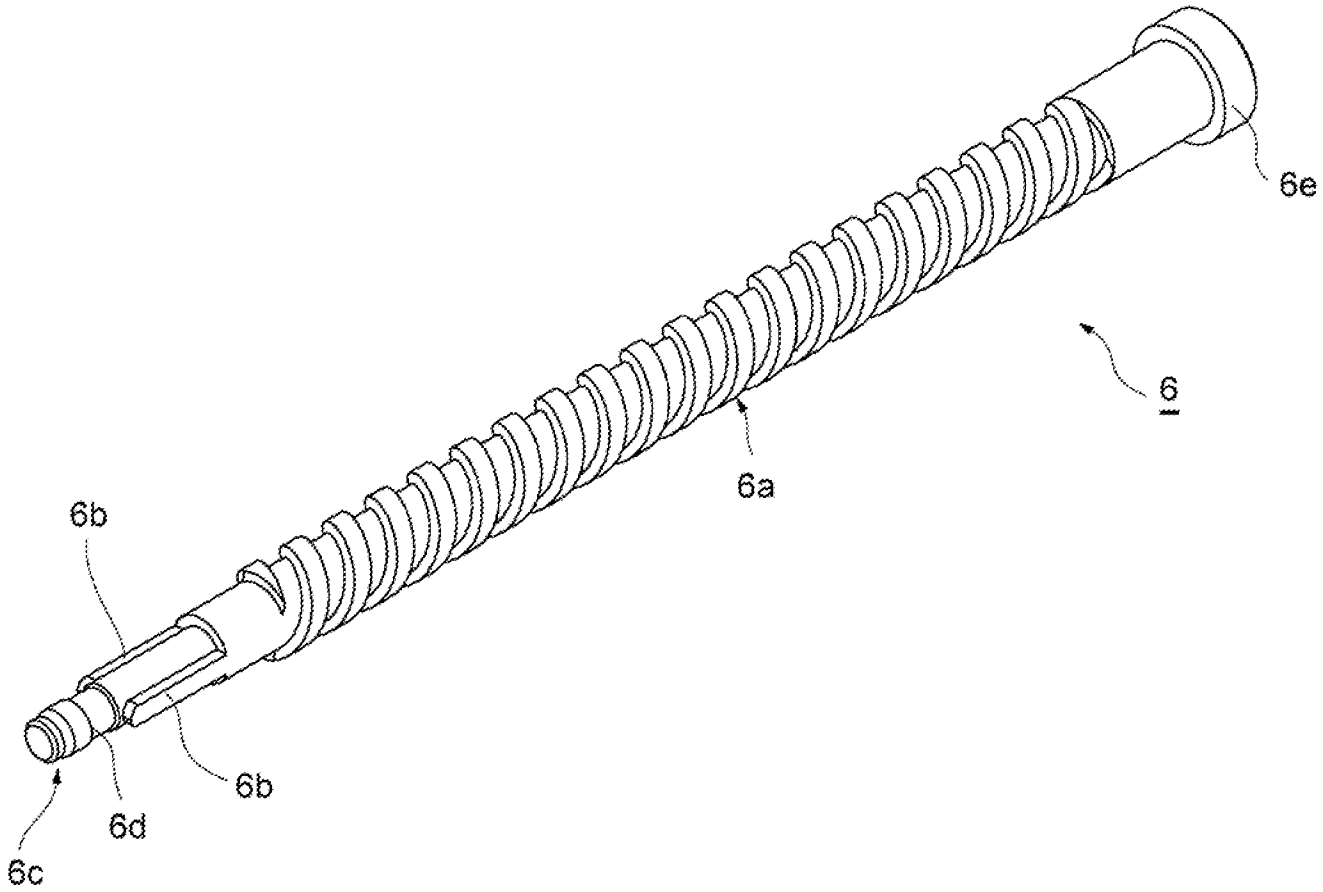
FIG. 9 is a perspective view illustrating a propelling rod in FIGS. 1 and 4.
Figure 10:
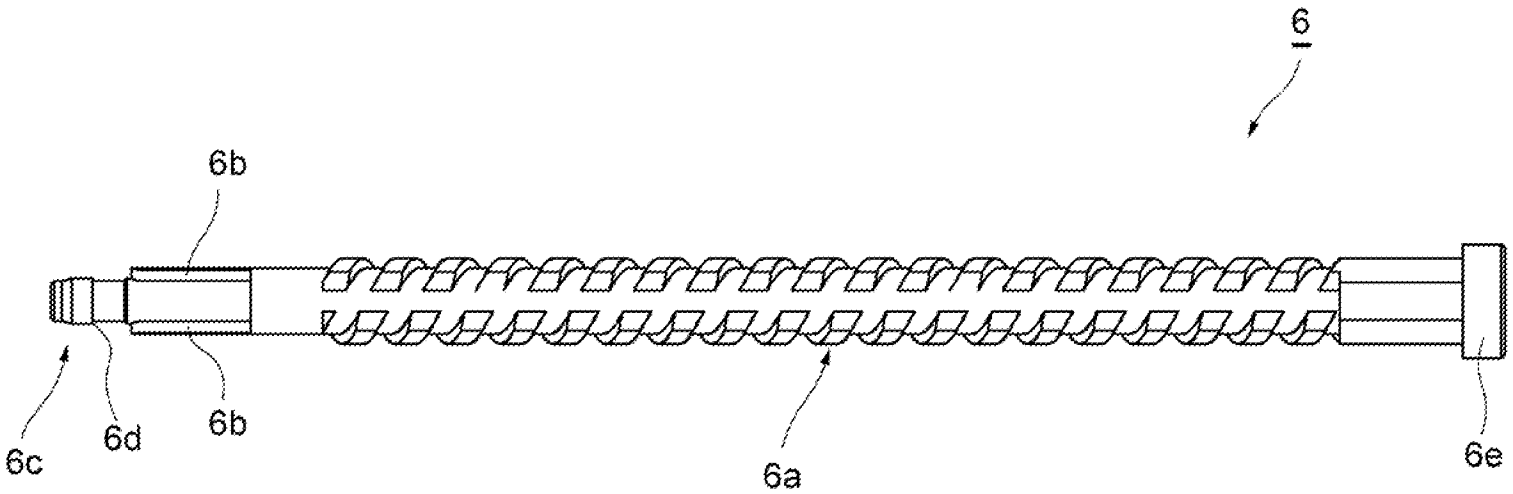
FIG. 10 is a side view of the propelling rod in FIGS. 1 and 4.
Figure 11:
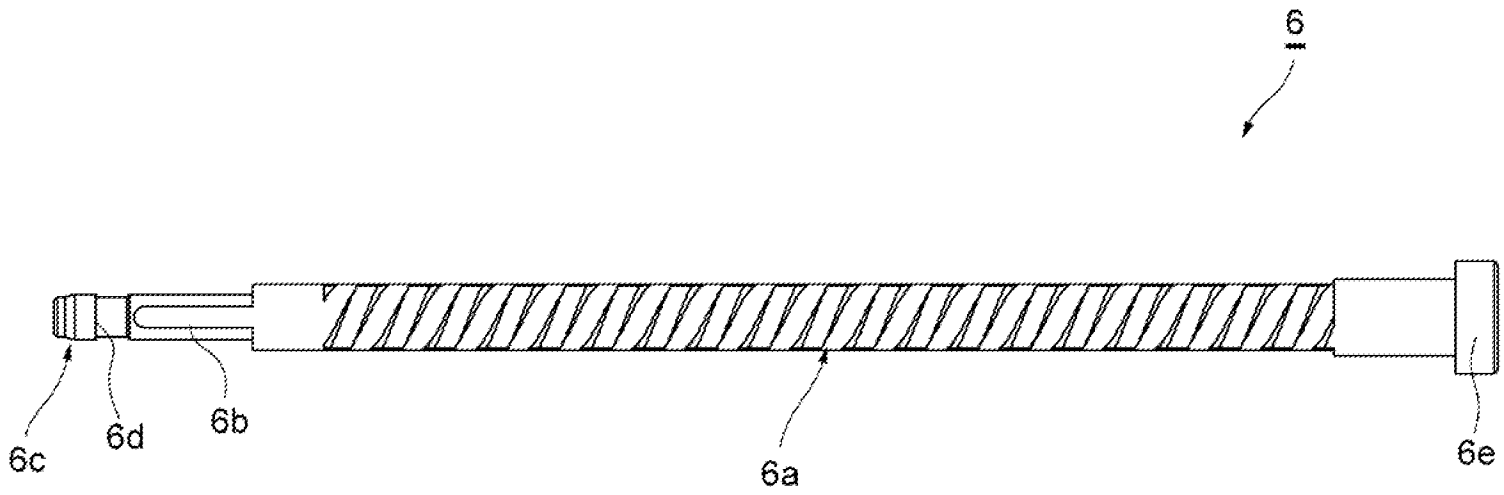
FIG. 11 is a plan view of the propelling rod illustrated in FIG. 10.
Figure 12:
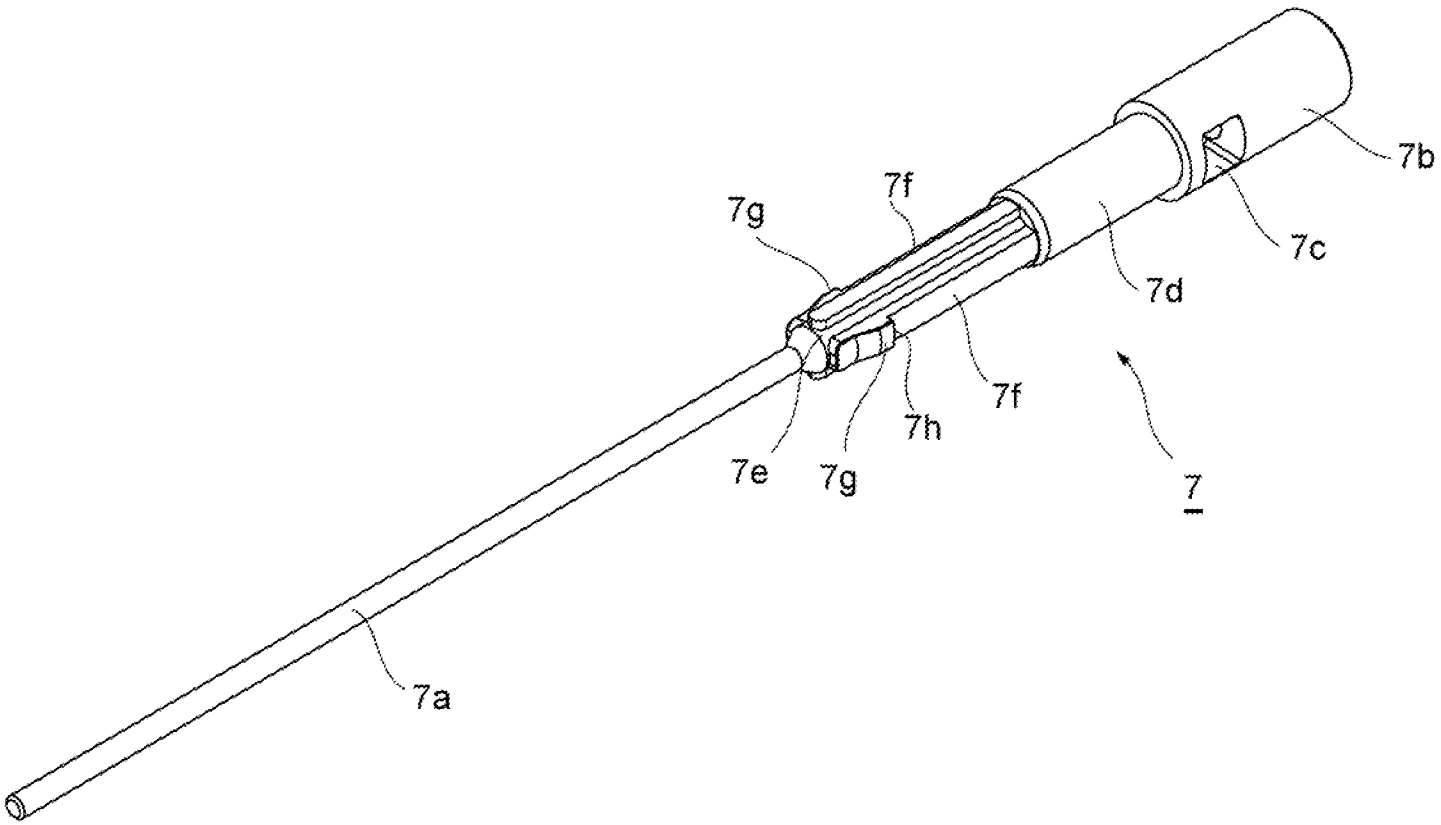
FIG. 12 is a perspective view illustrating the ejection rod in FIGS. 1 and 4.
Figure 13:
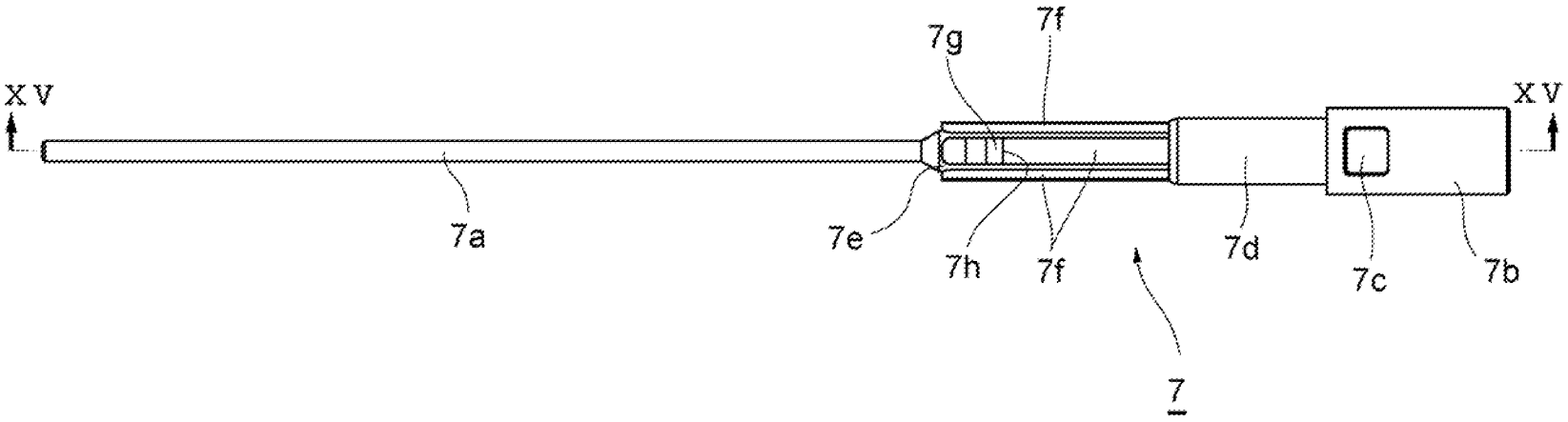
FIG. 13 is side view of the ejection rod illustrated in FIG. 12.
Figure 14:
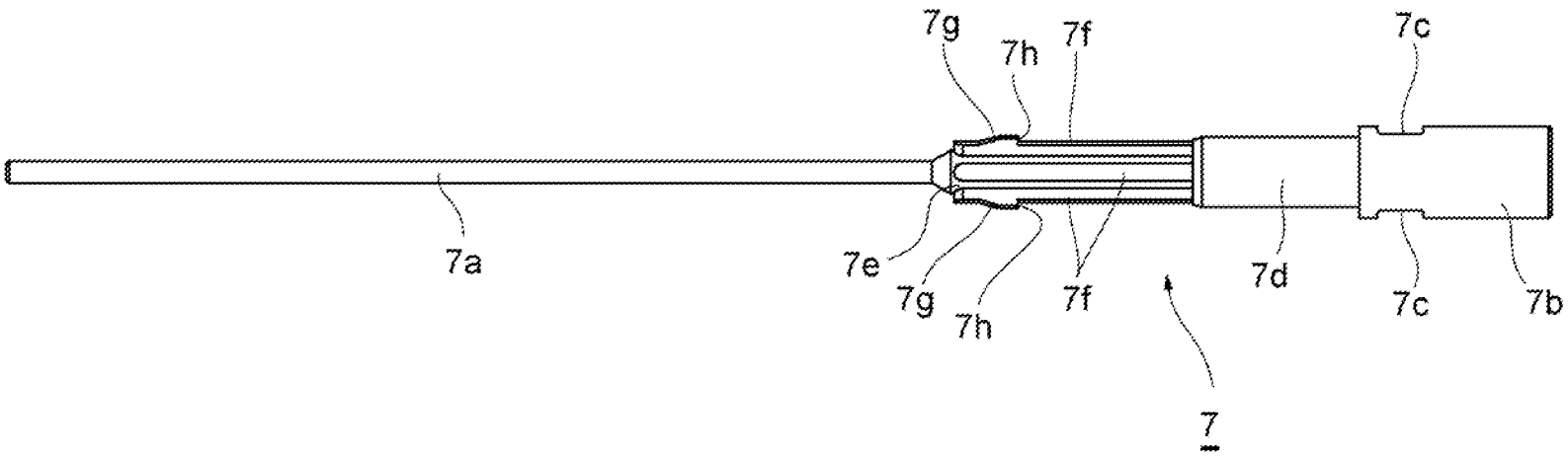
FIG. 14 is a plan view of the ejection rod illustrated in FIG. 13.
Figure 21:
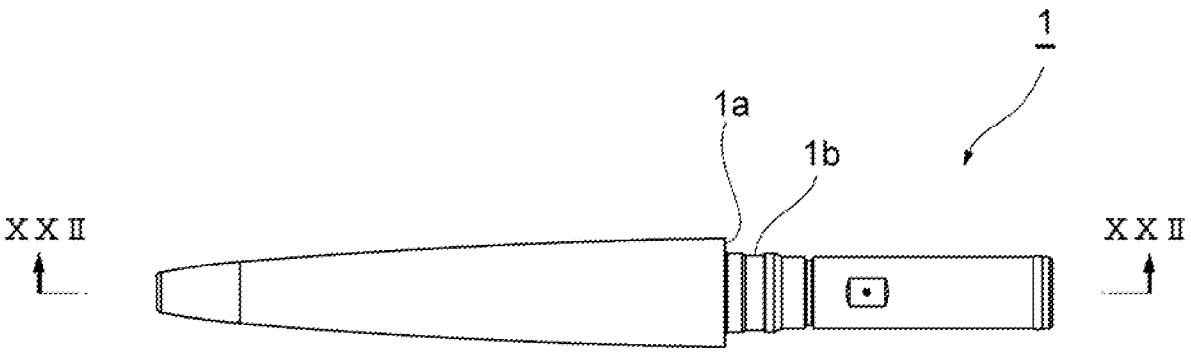
FIG. 21 is a plan view illustrating the sleeve in FIGS. 1 to 3.
Figure 22:
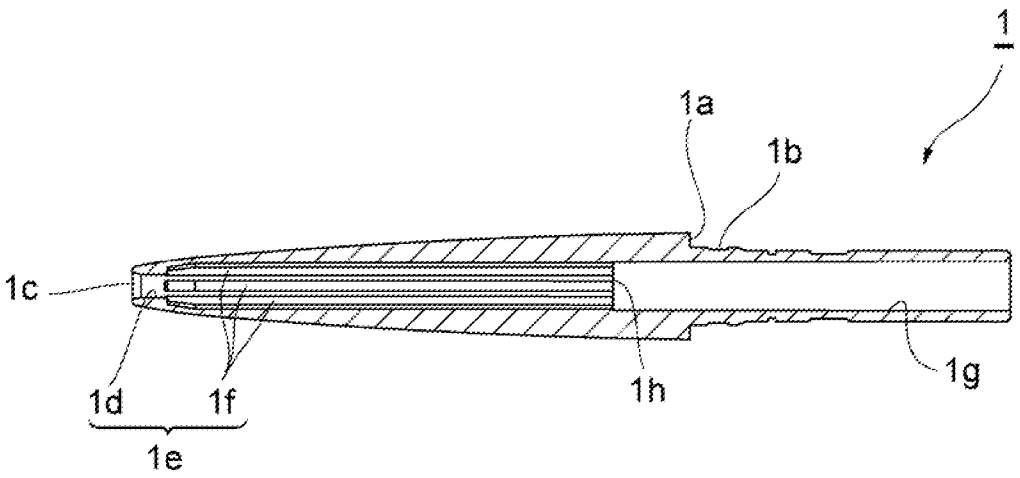
FIG. 22 is a cross-sectional view taken along a line XXII-XXII in FIG. 21.

Hereinafter, a preferred embodiment of a rod-shaped cosmetic material feeding container according to the present invention will be described with reference to FIGS. 1 to 22. FIGS. 1 to 3 are longitudinal cross-sectional views illustrating the rod-shaped cosmetic material feeding container according to an embodiment of the present invention. FIG. 1 is a view illustrating an initial state, FIG. 2 is a view illustrating a state in which a lead holder reaches an advancing limit, and FIG. 3 is a view illustrating a state in which an ejection rod is fed out to the maximum. FIG. 4 is a perspective view illustrating an inside of a sleeve and a barrel, FIGS. 5 and 6 are views illustrating the barrel, FIGS. 7 and 8 are views illustrating a screw, FIGS. 9 to 11 are views illustrating a propelling rod, FIGS. 12 to 15 are views illustrating the ejection rod, FIGS. 16 to 20 are views illustrating the lead holder, and FIGS. 21 and 22 are views illustrating the sleeve.

The rod-shaped cosmetic material feeding container of the present embodiment accommodates various rod-shaped cosmetic materials including an eyeliner, an eye blow, a lip liner, and a concealer, which may appropriately protrude and retract as required by a user, and the rod-shaped cosmetic material feeding container is particularly suitable for a rod-shaped cosmetic material having a small core diameter.

As illustrated in FIG. 1, the rod-shaped cosmetic material feeding container 100 has an elongated round rod shape like a writing instrument as a whole, and includes a sleeve 1 that constitutes a container front portion and a barrel 2 that constitutes a container rear portion as an outer shape. In the sleeve 1 and the barrel 2, a screw 3 that has a female screw 3*a* and is rotatable in synchronization with the barrel 2, and a mechanism portion 4 that is configured to grip the rod-shaped cosmetic material M and has a male screw 6*a* screwed to the female screw 3*a*, is synchronically rotatable with the sleeve 1 and movable in an axial direction, and is capable of advancing and retreating by a screwing action of the female screw 3*a* and the male screw 6*a* by relative rotation of the sleeve 1 and the barrel 2 are accommodated.

Figure 5:
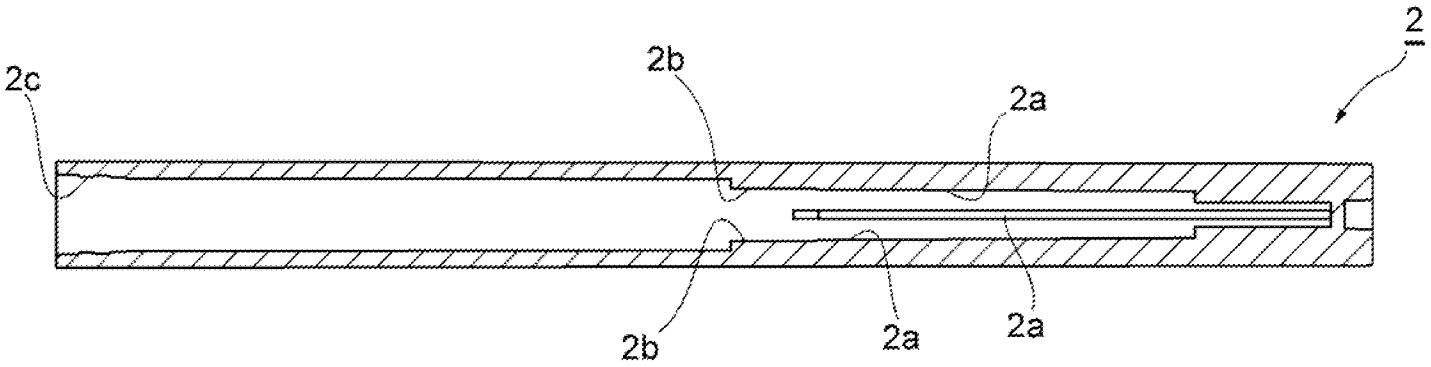
FIG. 5 is a longitudinal cross-sectional view illustrating the barrel in FIGS. 1 to 3.

The barrel 2 is made of, for example, acrylonitrile butadiene styrene (ABS) or the like, and is formed in a bottomed cylindrical shape elongated in the axial direction as illustrated in FIG. 5. As illustrated in FIG. 6, in the barrel 2, longitudinal ribs 2*a* extending from a bottom portion of the barrel to a position close to the middle in the axial direction on a front end side are provided on an inner peripheral surface of the barrel 2 and at positions equally spaced by 90° along a circumferential direction as members for reducing rattling of a later-described propelling rod 6, included in the mechanism portion 4, in a radial direction of the propelling rod 6.

As illustrated in FIG. 5, among the longitudinal ribs 2*a*, a pair of longitudinal ribs 2*a*, 2*a* facing each other in the radial direction further extend forward in the axial direction, and extending portions (protrusions) 2*b* are provided to synchronously rotate the screw 3. Further, a convex portion 2*c* for mounting the sleeve 1 is provided in an annular shape on an inner peripheral surface of a front end portion of the barrel 2.

The screw 3 is made of, for example, polyacetal or polyoxymethylene (POM) or the like, and is formed in a substantially cylindrical shape elongated in the axial direction as illustrated in FIGS. 7 and 8. The screw 3 includes a spring portion (resin spring) 3*b* that is configured to expand and contract in the axial direction in a portion other than a front end portion and a rear end portion of the screw 3, and the female screw 3*a* is provided on an inner peripheral surface of the rear end portion.

Guide portions 3*c* each of which are recessed in a substantially V shape are provided on an outer peripheral surface of the rear end portion of the screw 3. The guide portion 3*c* includes a slope (inclined passage) 3*e* spirally inclined and extending from a start portion 3*d* toward the rear in the axial direction, and a straight portion 3*g* linearly extending from an end portion 3*f* of the slope 3*e* toward a front in the axial direction, and two guide portions 3*c* each including the slope 3*e* and the straight portion 3*g* are continuously provided along the circumferential direction. The guide portion 3*c* of the screw 3 is for guiding the extending portions 2*b* of the barrel 2 when the rod-shaped cosmetic material M is taken out.

The sleeve 1 is made of, for example, an ABS or the like, and is formed in a stepped cylindrical shape having a step portion 1*a* on an outer peripheral surface in the middle in the axial direction, as illustrated in FIGS. 21 and 22, a small-diameter cylindrical portion connected to a rear side of the step portion 1*a* is an insertion portion to be inserted into the barrel 2, and a large-diameter cylindrical portion connected to a front side of the step portion 1*a* and having a tapered shape toward a front end is a gripping portion protruding from the front end of the barrel 2 and gripped by the user. A concave portion 1*b* for being engaged with the annular convex portion 2*c* of the barrel 2 in the axial direction is provided in an annular shape on an outer peripheral surface of the sleeve 1 on the rear side of the step portion 1*a*.

As illustrated in FIG. 22, the sleeve 1 is provided with a rod-shaped cosmetic material hole 1*d* that penetrates from an opening 1*c* at the front end to the middle in the axial direction and is configured to accommodate the rod-shaped cosmetic material M so that the rod-shaped cosmetic material M is slidable in the rod-shaped cosmetic material hole 1*d*.

Further, grooves 1*f* that are configured to accommodate gripping pieces 8*e* and gripping piece extension portions 8*b* of a core gripping portion 8*a* of a lead holder 8, which will be described later, constituting the mechanism portion 4, are continuously provided at a plurality of positions (here, four equally arranged positions) around the rod-shaped cosmetic material hole 1*d* from the vicinity of the opening 1*c* to the middle in the axial direction so that the gripping pieces 8*e* and the gripping piece extension portions 8*b* are slidable in the grooves 1*f*. An advancing and retreating hole 1*e* in which the rod-shaped cosmetic material M, the gripping pieces 8*e* of a core gripping portion 8*a* of the lead holder 8, and the gripping piece extension portions 8*b* slide is formed with the rod-shaped cosmetic material hole 1*d* and the grooves 1*f*. Further, a circular hole 1*g* for sliding the gripping piece extension portion 8*b* and a cylindrical portion 8*c* to be described later of the lead holder 8 is provided from the middle to the rear end in the axial direction and is connected to the advancing and retreating hole 1*e* of the sleeve 1. A boundary surface 1*h* between the circular hole 1*g* and the advancing and retreating hole 1*e* whose diameter is smaller than that of the circular hole 1*g* serves as an advancing limit of the lead holder 8.

As illustrated in FIG. 1, the screw 3 is inserted into the barrel 2 from a rear end side thereof, the sleeve 1 is inserted into the front end side of the barrel 2 from the insertion portion thereof, the step portion 1*a* is abutted against a front end surface of the barrel 2, and the concave portion 1*b* is engaged with the convex portion 2*c* of the barrel 2 in the axial direction, so that the sleeve 1 is rotatably mounted on the barrel 2 and immovable in the axial direction. Further, the spring portion 3*b* of the screw 3 is disposed between a rear end surface of the sleeve 1 and the front end portion of the extending portions 2*b* (see FIG. 5) of the barrel 2, and the front end portion of the extending portions 2*b* of the barrel 2 enters a space between the start portion 3*d* and the linear portion 3*g* of the slope 3*e* (see FIGS. 4 and 7). Accordingly, when the barrel 2 is rotated in a clockwise direction, which corresponds to a feeding-out direction of the mechanism portion 4 when viewed from the rear side in the axial direction (see FIG. 7), an operation resistance is generated between the start portion 3*d* of the slope 3*e* and the front end portion of the extending portion 2*b* of the barrel 2, and the barrel 2 and the screw 3 are synchronously rotatable with each other.

As illustrated in FIGS. 1 and 4, the mechanism portion 4 includes the lead holder 8 that includes a core gripping portion 8*a* capable of gripping the rod-shaped cosmetic material M and is engaged with the sleeve 1 in a rotation direction, an ejection rod 7 that is disposed inside the lead holder 8, includes a rod-shaped portion 7*a* extending forward in the axial direction, is engaged with the lead holder 8 in the rotation direction, and is movable in the axial direction, a propelling rod 6 that extends rearward in the axial direction from the ejection rod 7, is engaged with the ejection rod 7 in the rotation direction, and has a function of being screwed with the screw 3, and a compression spring 9 that is sandwiched between the lead holder 8 and the ejection rod 7.

The propelling rod 6 is made of, for example, POM or the like, and is formed in a substantially round rod shape elongated in the axial direction as illustrated in FIGS. 1 and 9 to 11. The propelling rod 6 includes a male screw 6*a* extending in the axial direction at a portion other than a front end portion and a rear end portion as a screw to be screwed with the female screw 3*a* of the screw 3. The male screw 6*a* has a surface cut at a position facing the radial direction along the axial direction, and extends in the axial direction so as to sandwich the cut surface. That is, the male screw 6*a* is provided so as to intermittently draw a spiral along the axial direction.

The propelling rod 6 has a pair of extending portions 6*b* extending forward in the axial direction with the same diameter as the shaft portion of the male screw 6*a* on a side where the male screw 6*a* is provided on a front side of the male screw 6*a* in the axial direction, and a portion other than the pair of extending portions 6*b* is a shaft portion having a reduced diameter. The extending portion 6*b* is a convex portion protruding in the radial direction compared with the shaft portion having the reduced diameter, and the extending portion 6*b* is provided to be engaged with the ejection rod 7 in the rotation direction.

The front side in the axial direction of the part including the pair of extending portions 6*b* of the propelling rod 6 is the shaft portion having a reduced diameter, and the front side in the axial direction of the shaft portion having the reduced diameter is a front end portion 6*c* of the propelling rod 6. A diameter of the front end portion 6*c* is larger than the shaft portion having the reduced diameter. The diameter of the front end portion 6*c* is gradually reduced toward a front end side. A rear end surface 6*d* of the front end portion 6*c* is provided to be engaged with the ejection rod 7 in the axial direction.

A flange 6*e* having an enlarged diameter is provided at the rear end portion of the propelling rod 6 so as to be brought into close contact with, engaged with a rear end surface of the screw 3, and synchronously rotatable with the screw 3.

Figure 15:
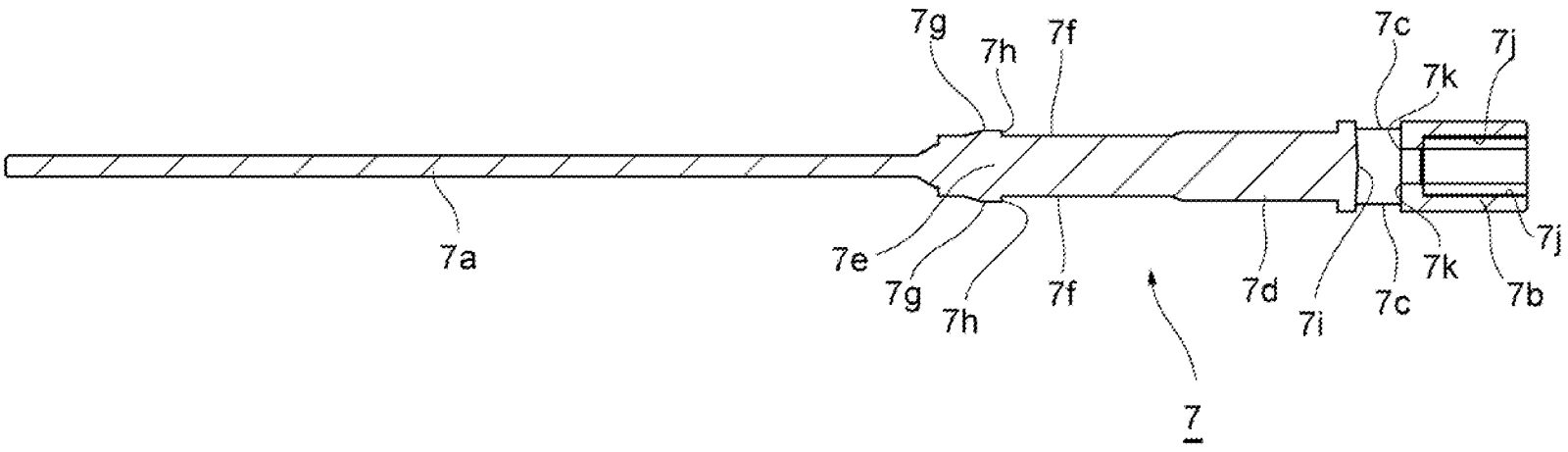
FIG. 15 is a cross-sectional view taken along a line XV-XV in FIG. 13.
Figure 16:
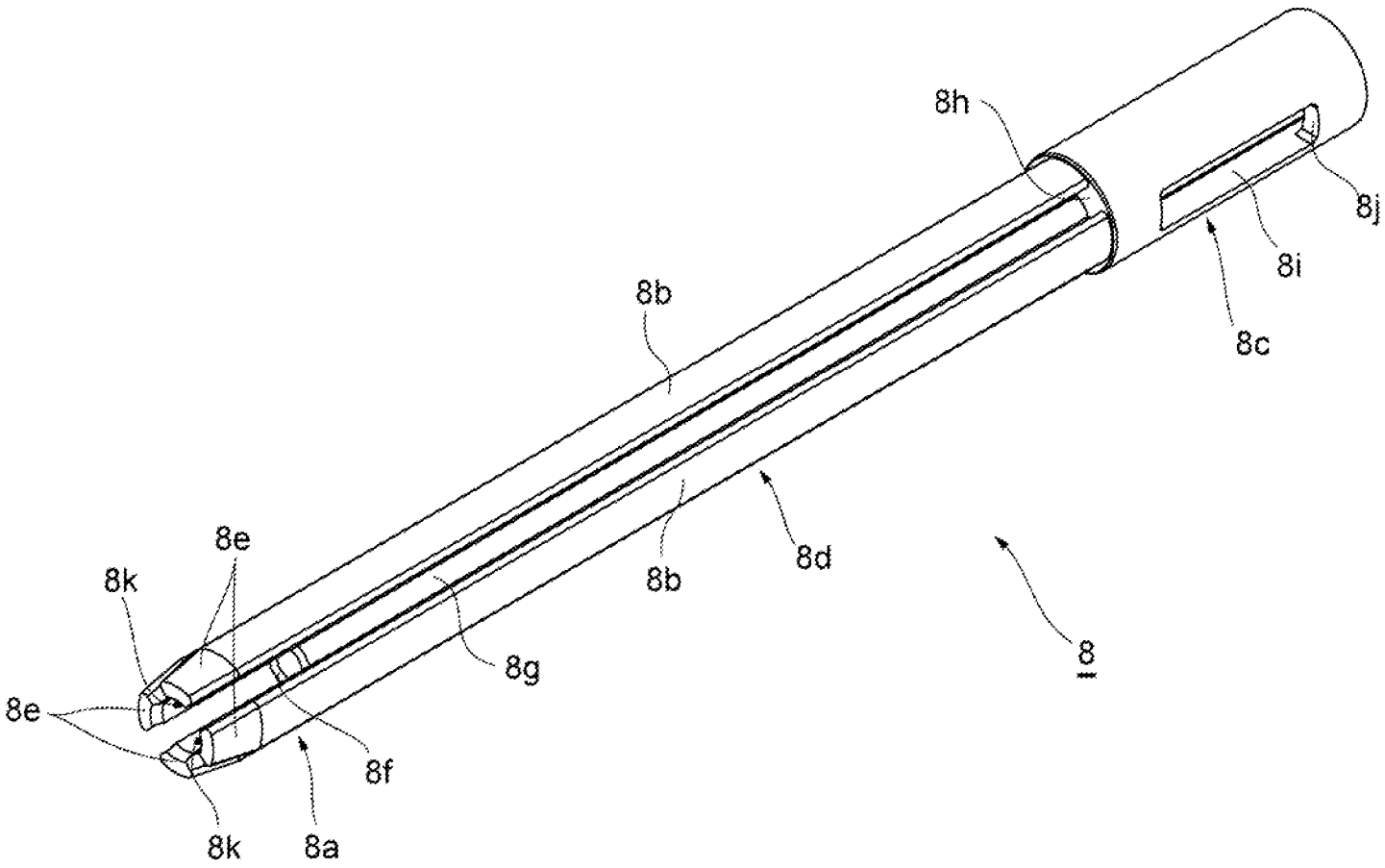
FIG. 16 is a perspective view illustrating the lead holder in FIGS. 1 and 4.
Figure 17:
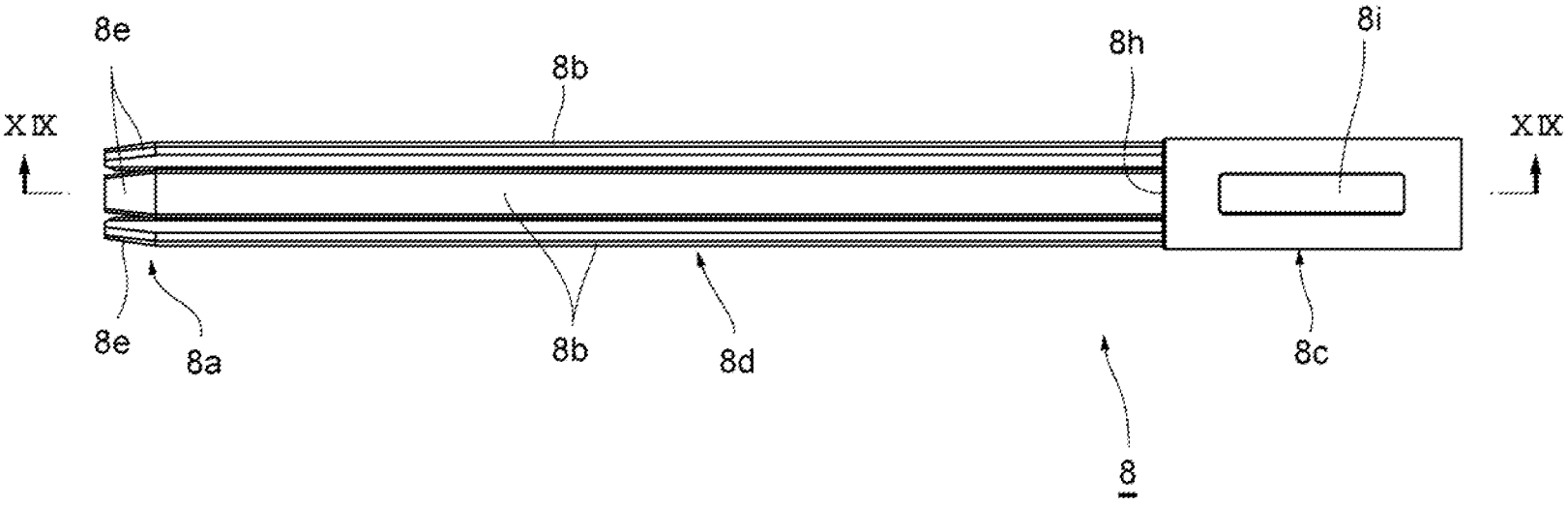
FIG. 17 is a side view of the lead holder illustrated in FIG. 16.
Figure 18:
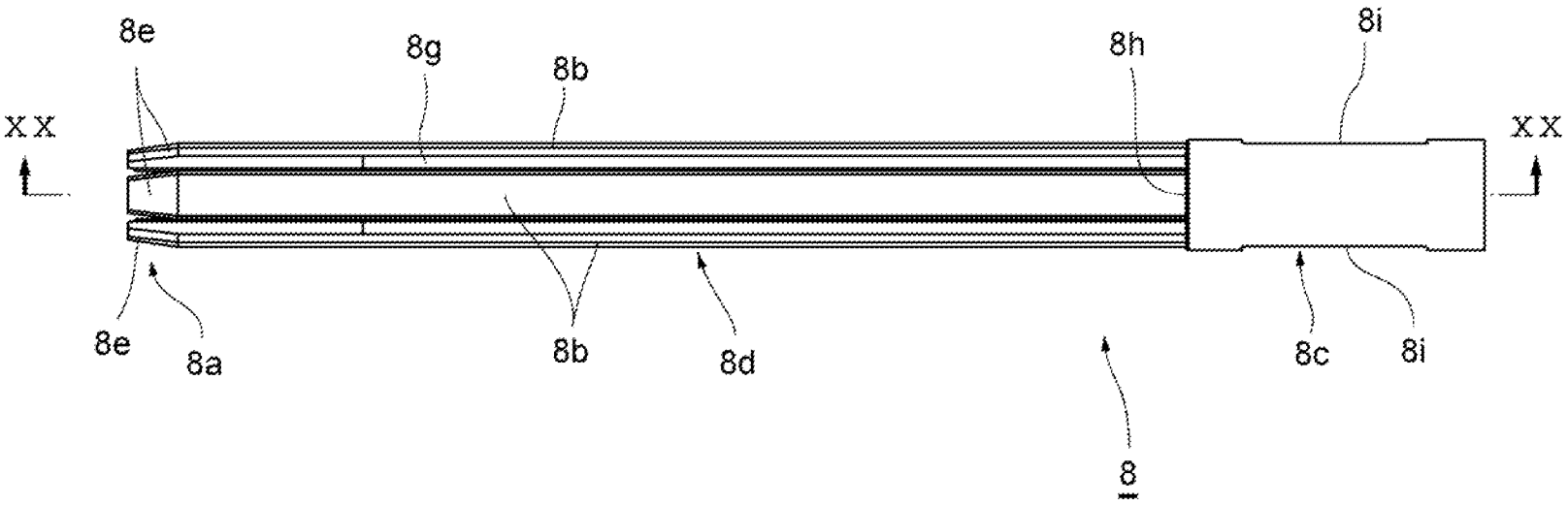
FIG. 18 is a plan view of the lead holder illustrated in FIG. 17.

The ejection rod 7 is made of, for example, POM or the like, and as illustrated in FIGS. 1 and 12 to 15, the rod-shaped portion 7*a* is provided at a front end of the ejection rod 7, and a shaft portion whose diameter gradually increases is continuously provided on a rear side of the rod-shaped portion 7*a* in the axial direction. A cylindrical portion 7*b* at a rear end portion is for accommodating the front end portion 6*c* and the extending portions 6*b* on the front side of the male screw 6*a* of the propelling rod 6, and as illustrated in FIG. 15, a pair of concave portions 7*j* for allowing the extending portions 6*b* of the propelling rod 6 to enter and for being engaged with the extending portions 6*b* in the rotational direction are provided at a position facing the rear half portion of the cylindrical hole in the radial direction. The concave portions 7*j* extend by a predetermined length in the axial direction.

Further, a pair of windows 7*c* each communicating the inside of the cylinder with the outside of the cylinder is provided in front of the concave portions 7*j* of the cylindrical portion 7*b* at positions facing each other in the radial direction. On inner peripheral surfaces of the windows 7*c* directly below a rear end in the axial direction, convex portions 7*k* protruding inward are provided to prevent the rear end surface 6*d* of the front end portion 6*c* of the propelling rod 6 from moving rearward in the axial direction. Further, the front end of the cylindrical hole of the cylindrical portion 7*b* is closed, and the front end surface 7*i* is provided to prevent the forward movement of the front end portion 6*c* of the propelling rod 6 in the axial direction.

As illustrated in FIGS. 12 to 15, a round rod-shaped shaft portion 7*d* is continuously provided on the front side of the cylinder portion 7*b* of the ejection rod 7 in the axial direction, and a round rod-shaped shaft portion 7*e* having a reduced diameter of the shaft portion 7*d* is continuously provided on a front side of the shaft portion 7*d* in the axial direction. Ridges 7*f* extending in the axial direction are respectively provided at positions equally spaced by 90° along a circumferential direction of the shaft portion 7*e*. Convex portions 7*g* engaged with the lead holder 8 in the rotation direction and moving in the axial direction with respect to the lead holder 8 are respectively provided at front end portions of a pair of ridges 7*f* that face each other in the radial direction among the ridges 7*f* A rear end surface 7*h* of the convex portion 7*g* is provided to prevent a retreating movement with respect to the lead holder 8. Further, the ridge 7*f* on which the convex portion 7*g* is not provided is for reinforcement.

The rod-shaped portion 7*a* of the ejection rod 7 is continuously provided at the front end of the shaft portion 7*e*, and is formed in a small-diameter round rod shape elongated in the axial direction. The rod-shaped portion 7*a* is for discharging a consumed rod-shaped cosmetic material M from the core gripping portion 8*a* of the lead holder 8.

The lead holder 8 is made of, for example, polybutylene terephthalate (PBT) or the like, and as illustrated in FIGS. 1, 4, and 16 to 20, the core gripping portion 8*a* for gripping the rod-shaped cosmetic material M is provided at a front end portion of the lead holder 8. A cylindrical portion 8*c* having a diameter larger than that of the core gripping portion 8*a* is provided at a rear end portion. A rod-shaped portion holder 8*d* accommodating the rod-shaped portion 7*a* of the ejection rod 7 is provided between the core gripping portion 8*a* and the cylindrical portion 8*c*.

The core gripping portion 8*a* grips the inserted rod-shaped cosmetic material M, and includes four gripping pieces 8*e* that are provided at intervals of 90° along a circumferential direction and enter the grooves if of the sleeve 1, and a bottom surface 8*f* against which a rear end surface of the rod-shaped cosmetic material M abuts. Note that the number of gripping pieces 8*e* is not limited as long as the number is plural, and it is more preferable that the ridges 8*k* extending in the axial direction are provided on inner surfaces of the gripping pieces 8*e* so as to break into the rod-shaped cosmetic material M.

The rod-shaped portion holder 8*d* includes a pipe 8*g* that extends rearward in the axial direction with the bottom surface 8*f* of the core gripping portion 8*a* as a front end surface and reaches the cylindrical portion 8*c*, and grip piece extension portions 8*b* that are continuously provided around the pipe 8*g*. The gripping pieces 8*e* are extended rearward in the axial direction, and reach the cylindrical portion 8*c*. The cylindrical hole of the pipe 8*g* is for the rod-shaped portion 7*a* of the ejection rod 7 to advance and retreat.

The cylindrical portion 8*c* has a diameter larger than that of the rod-shaped portion holder 8*d*, and a step surface 8*h* of the cylindrical portion 8*c* is configured to abut against an advancing limit (boundary surface) 1*h* of the sleeve 1.

The cylindrical portion 8*c* is provided with a pair of windows 8*i* that communicate the inside of the cylinder with and the outside of the cylinder. The windows 8*i* are disposed at positions facing each other in the radial direction. The window 8*i* is formed so that the convex portion 7*g* of the ejection rod 7 can enter, advance and retreat, and is for being engaged with the ejection rod 7 in the rotation direction. The length of the window 8*i* in the axial direction is set to be substantially the same as a moving length of the ejection rod 7.

Figure 19:
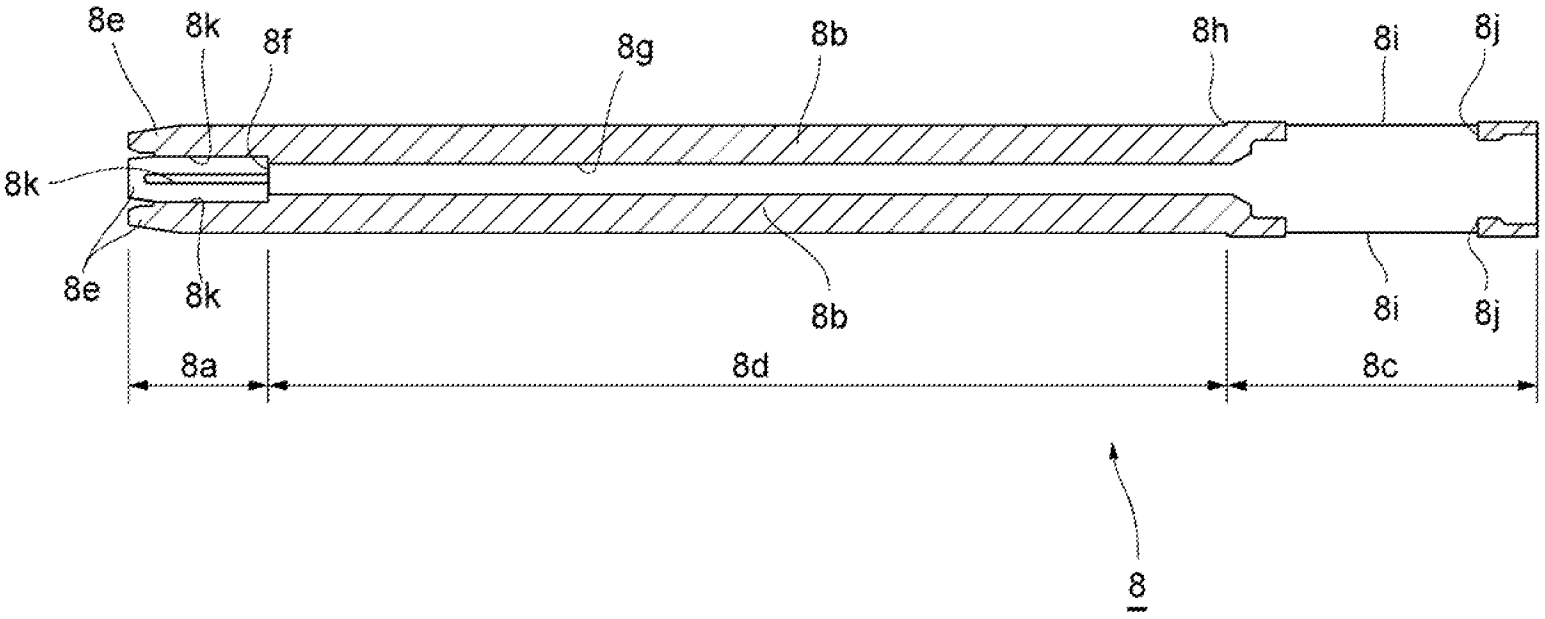
FIG. 19 is a cross-sectional view taken along a line XIX-XIX in FIG. 17.
Figure 20:
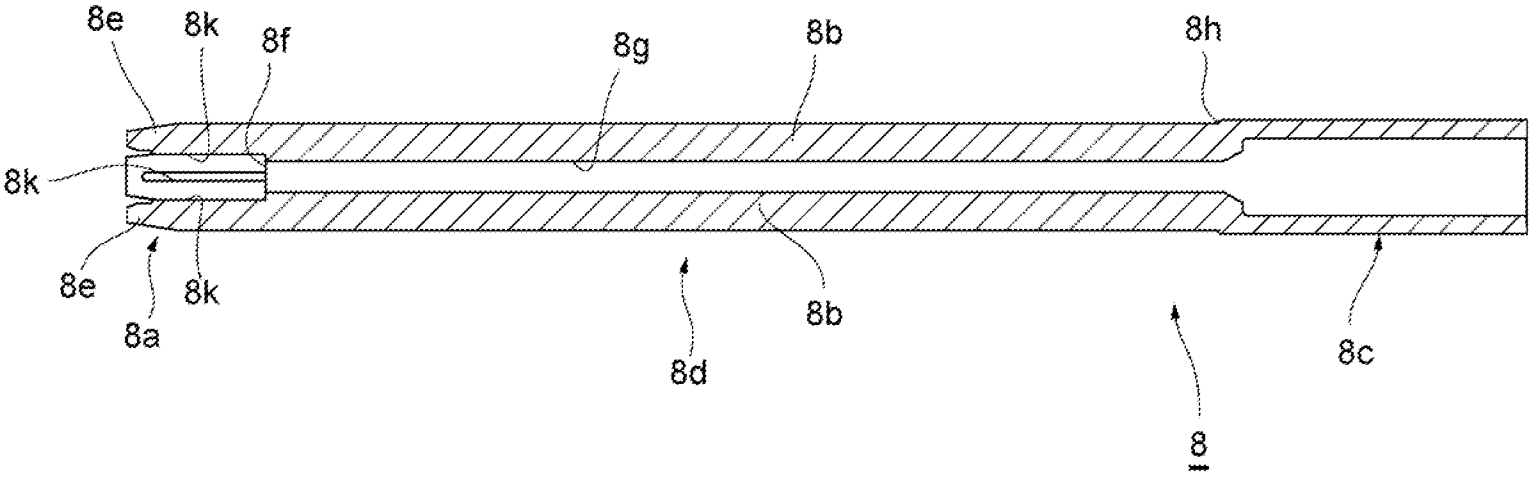
FIG. 20 is a cross-sectional view taken along a line XX-XX in FIG. 18.

As illustrated in FIG. 19, on the inner peripheral surface directly below rear ends of the windows 8*i* in the axial direction, convex portions 8*j* protruding inward are provided to prevent the convex portions 7*g* of the ejection rod 7 from moving rearward in the axial direction. Further, the shape of a front end side of the cylindrical hole of the cylindrical portion 8*c* is a shape following the front end side of the shaft portion 7*e* and the ridges 7*f* of the ejection rod 7.

As illustrated in FIG. 1, the propelling rod 6 is inserted into the barrel 2 in a state where the male screw 6*a* is screwed to the female screw 3*a* of the screw 3, and a flange 6*e* at a rear end portion of the propelling rod 6 is located at a retreating limit at which the flange 6*e* abuts against an inner surface of a rear end of the barrel 2.

Further, a rear end side of the ejection rod 7 is inserted into the front end side of the ejection rod 6, and the extending portion 6*b* of the ejection rod 6 enters the concave portion 7*j* of the ejection rod 7 and is engaged with the concave portion 7*j* in the rotation direction, so that the ejection rod 7 is synchronously rotatable with the ejection rod 6. Further, the front end portion 6*c* of the propelling rod enters the front end side of the cylindrical hole of the cylindrical portion 7*b* of the ejection rod 7, the rear end surface 6*d* of the front end portion 6*c* abuts against the convex portions 7*k* of the ejection rod 7, and a front end surface of the front end portion 6*c* faces the front end surface 7*i* of the cylindrical hole of the cylindrical portion 7*b* of the ejection rod 7, so that the ejection rod 7 cannot move in the axial direction with respect to the propelling rod 6.

The compression spring 9 is externally inserted so as to abut against a front end surface of the cylindrical portion 7*b* of the ejection rod 7, and a rear end side of the lead holder 8 is inserted into an inside of the front end side of the ejection rod 7, and the compression spring 9 is disposed between the rear end portion of the lead holder 8 and the front end surface of the cylindrical portion 7*b* of the ejection rod 7 (see FIG. 4).

The rod-shaped portion 7*a* of the ejection rod 7 enters the cylindrical hole of the pipe 8*g* of the lead holder 8, and the shaft portion 7*e* and the ridges 7*f* of the ejection rod 7 enter the cylindrical hole of the cylindrical portion 8*c* of the lead holder 8. The convex portion 7*g* of the ejection rod 7 enters the window 8*i* and is engaged with the window 8*i* in the rotation direction, so that the lead holder 8 is synchronously rotatable with the ejection rod. The convex portion 7*g* of the ejection rod 7 enters the window 8*i*, so that the ejection rod 7 is movable in the axial direction in the lead holder 8. The lead holder 8 is urged forward with respect to the ejection rod 7 by the compression spring 9, so that the convex portion 8*j* of the lead holder 8 abuts against the rear end surface 7*h* of the convex portion 7*g* of the ejection rod 7.

In this state, a front end surface of the rod-shaped portion 7*a* of the ejection rod 7 is flush with the bottom surface 8*f* of the core gripping portion 8*a* of the lead holder 8.

Then, the sleeve 1 is externally inserted into the lead holder 8 such that the gripping pieces 8*e* and the gripping piece extension portions 8*b* of the lead holder 8 enter the grooves if of the sleeve 1, and the sleeve 1 is pushed into the barrel 2, so that the sleeve 1 is rotatably mounted on the barrel 2 and immovable in the axial direction as described above. In this state, the rod-shaped cosmetic material M is gripped by the core gripping portion 8*a* of the lead holder 8, and the rod-shaped cosmetic material feeding container 100 in the initial state illustrated in FIG. 1 is obtained.

In the rod-shaped cosmetic material feeding container 100, the propelling rod 6 is located at the retreating limit, and a front end surface of the rod-shaped cosmetic material M is located in the vicinity of the opening 1*c*.

Next, the operation of the rod-shaped cosmetic material feeding container 100 having such a configuration will be described. When the sleeve 1 and the barrel 2 are relatively rotated by the user in the feeding-out direction in which the mechanism portion 4 is fed out, since the barrel 2 and the screw 3 are synchronously rotatable by the operation resistance generated between the extending portion 2*b* (see FIGS. 5 and 6) of the barrel 2 and the start portion 3*d* (see FIGS. 4 and 7) of the slope 3*e* of the screw 3, the mechanism portion 4 is fed out (advances) by the screwing action of the female screw 3*a* of the screw 3 and the male screw 6*a* of the propelling rod 6 of the mechanism portion 4. That is, the propelling rod 6, the ejection rod 7, the lead holder 8, and the compression spring 9, which are synchronously rotatable with each other, are fed out, and the rod-shaped cosmetic material M appears from the opening 1*c* of the sleeve 1 and is used for application. When the propelling rod 6 is fed out, the flange 6*e* disposed at the rear end portion of the propelling rod 6 is guided in the radial direction by the longitudinal ribs 2*a* (see FIGS. 5 and 6) of the barrel 2 to prevent rattling.

Then, when the application is finished and the sleeve 1 and the barrel 2 are relatively rotated in a reverse direction (feeding-back direction), the mechanism portion 4 retreats by the screwing action of the female screw 3*a* and the male screw 6*a*, and the rod-shaped cosmetic material M enters into the opening 1*c* of the sleeve 1.

Then, when the rod-shaped cosmetic material M is consumed as it is used, the position of the mechanism portion 4 advances in the axial direction, and when the rod-shaped cosmetic material M is almost used up, as illustrated in FIG. 2, the step surface 8*h* of the lead holder 8 of the mechanism portion 4 abuts against the advancing limit 1*h* of the sleeve 1, and the lead holder 8 is prevented from being further fed out. At this time, there is a gap S between the front end surfaces of the gripping pieces 8*e* of the lead holder 8 and front end surfaces of the grooves if of the sleeve 1. A reason why the gap S is provided in this manner is to prevent the front end surfaces of the gripping pieces 8*e* of the lead holder 8 from abutting against the front end surfaces of the groove if of the sleeve 1 and from transmitting an impact to the rod-shaped cosmetic material M.

In this state, the advance is restricted by the flange 6*e* of the propelling rod 6 of the mechanism portion 4 that has been fed out abutting against and in close contact with the rear end surface of the screw 3. In this state, when the sleeve 1 and the barrel 2 are further rotated relative to each other in the feeding-out direction, a rotational force applied to the barrel 2 exceeds the operation resistance generated between the extending portions 2*b* (see FIG. 5) of the barrel 2 and the start portion 3*d* (see FIG. 7) of the slope 3*e* of the screw 3, the screw 3 is engaged with the propelling rod 6, and the screw 3 and the propelling rod 6 are synchronously rotatable.

Then, the extending portion 2*b* of the barrel 2 pushes up the spiral slope 3*e* (see FIG. 7) of the screw 3, and the slope 3*e* is pushed forward while compressing the spring portion 3*b* of the screw 3, so that the propelling rod 6 and the ejection rod 7 are fed out while compressing the compression spring 9. At this time, the convex portion 7*g* of the ejection rod 7 advances through the window 8*i* of the lead holder 8, and the rod-shaped portion 7*a* of the ejection rod 7 enters the core gripping portion 8*a* of the lead holder 8.

Then, when the extending portions 2*b* of the barrel 2 reach the end portions 3*f* (see FIG. 7) of the slopes 3*e* of the screw 3, the rod-shaped portion 7*a* of the ejection rod 7 reaches the advancing limit, and as illustrated in FIG. 3, the front end surface of the rod-shaped portion 7*a* becomes substantially flush with the front end surfaces of the gripping pieces 8*e*, and the rod-shaped cosmetic material is pushed out from the core gripping portion 8*a* and discharged.

Then, when the rod-shaped cosmetic material M is discharged and the extending portions 2*b* of the barrel 2 pass over the end portions 3*f* of the slopes 3*e* of the screw 3, the extending portions 2*b* of the barrel 2 move to the start portions 3*d* of the slopes 3*e*, and the rod-shaped portion 7*a* of the ejection rod 7 automatically exits from the core gripping portion 8*a* (see FIG. 2) by an urging force of the compression spring 9. When the sleeve 1 and the barrel 2 are continuously and relatively rotated in the feeding-out direction, click sound of "tick-tick" is repeated and a similar operation is repeated.

Then, after discharging the rod-shaped cosmetic material M, the user pushes and grips a new rod-shaped cosmetic material M into the core gripping portion 8*a* while holding the new rod-shaped cosmetic material M, so that the new rod-shaped cosmetic material M is loaded. In a configuration in which the rod-shaped cosmetic material M is discharged before the extending portions 2*b* of the barrel 2 reach the end portions 3*f* of the slopes 3*e* of the screw 3, or in a configuration in which the compression spring 9 is not provided, the rod-shaped portion 7*a* of the ejection rod 7 may not automatically exit from the core gripping portion 8*a*, and the user may have to relatively rotate the sleeve 1 and the barrel 2 in the reverse direction (feeding-back direction) and make the rod-shaped portion 7*a* of the ejection rod 7 retreat from the core gripping portion 8*a*.

As described above, in the present embodiment, the mechanism portion 4 including the lead holder 8, the ejection rod 7, the propelling rod 6, and the compression spring 9 is synchronously rotatable with the sleeve 1, the barrel 2 and the screw 3 are synchronously rotatable, and when the sleeve 1 and the barrel 2 are relatively rotated in the feeding-out direction, the screwing action of the female screw 3*a* of the screw 3 and the male screw 6*a* of the propelling rod 6 works to feed out the mechanism portion 4, and when the lead holder 8 of the mechanism portion 4 reaches the advancing limit 1*h*, the propelling rod 6 is engaged with the screw 3 so as to be synchronously rotatable, and when the sleeve 1 and the barrel 2 are further relatively rotated in the feeding-out direction, the extending portions 2*b* provided inside the barrel 2 abut against the slopes 3*e* of the screw 3, and the slopes 3*e* are pushed forward while compressing the spring portion 3*b* of the screw 3. Accordingly, the propelling rod 6 and the ejection rod 7 are fed out while compressing the compression spring 9, and the rod-shaped portion 7*a* of the ejection rod 7 enters the core gripping portion 8*a* of the lead holder 8, so that the remaining rod-shaped cosmetic material M gripped by the core gripping portion 8*a* is pushed out by the rod-shaped portion 7*a* of the ejection rod 7, and the rod-shaped cosmetic material M can be discharged without dirtying the fingers. Further, the rod-shaped cosmetic material M can be loaded by pushing the new rod-shaped cosmetic material M into the core gripping portion 8*a* and gripping the new rod-shaped cosmetic material M. That is, when the rod-shaped cosmetic material M is replaced, there is no waste like a refill container, and the rod-shaped cosmetic M can be easily replaced while the environment is protected. Further, since the compression spring 9 and the spring portion 3*b* of the screw 3 are disposed in the container, the rod-shaped cosmetic material M can be protected from the impact even when the impact is applied to the container.

Further, when the extending portions 2*b* of the barrel 2 abut against and move from the start portions 3*d* to the end portions 3*f* of the slopes 3*e*, the length of the ejection rod 7 to be fed out is equal to the core gripping length in the axial direction of the core gripping portion 8*a* of the lead holder 8, so that the rod-shaped cosmetic material M can be reliably discharged. Even if the length of the ejection rod 7 to be fed out is set to be longer than the core gripping length in the axial direction of the core gripping portion 8*a* of the lead holder 8, the rod-shaped cosmetic material M can be reliably discharged.

Further, one or a plurality of slopes 3*e* are provided along the circumferential direction of the screw 3, and when the abutment of the extending portions 2*b* of the barrel 2 against the slopes 3*e* exceeds the end portions 3*f* of the slopes 3*e*, the extending portions 2*b* of the barrel 2 move to the start portions 3*d* of the slopes 3*e*, the rod-shaped portion 7*a* of the ejection rod 7 retreats until the rod-shaped portion 7*a* exits from the core gripping portion 8*a*, and the rod-shaped portion 7*a* of the ejection rod 7 exits from the core gripping portion 8*a* without relatively rotating the sleeve 1 and the barrel 2 in the reverse direction by the urging force of the compression spring 9. Therefore, the rod-shaped cosmetic material M can be pushed into the core grip portion 8*a* and gripped without any trouble, and the rod-shaped cosmetic M can be loaded more easily.

Although the present invention has been specifically described above based on the embodiment, the present invention is not limited to the above embodiment, and for example, in the above embodiment, the flange 6*e* at the rear end portion of the propelling rod 6 is particularly preferable as an engaging portion that is in close contact with and is engaged with the screw 3 so as to be synchronously rotatable, but instead of the flange 6*e*, another engaging portion may be provided in order to synchronously rotate the screw 3 and the propelling rod 6.

Further, in the above embodiment, two slopes 3*e* are provided along the circumferential direction of the screw 3 as being particularly preferable from the viewpoint of design, but the number of slopes 3*e* may be singular or three or more.

Further, the shape of each component including the rod-shaped cosmetic material M, the barrel 2, and the sleeve 1 is not limited to a circular shape, and may be a square shape, an elliptical shape, a flat shape, or the like.

What is claimed is:

1. A rod-shaped cosmetic material feeding container comprising:

a sleeve that is capable of accommodating a rod-shaped cosmetic material;

a barrel that is engaged with the sleeve so as to be rotatable relative to the sleeve;

a screw that is disposed inside the barrel so as to be synchronously rotatable; and a mechanism portion that is accommodated inside the sleeve and the barrel and configured to feed out the rod-shaped cosmetic material, wherein the screw includes:

a slope that is provided at a rear portion of the screw; and a female screw that is provided on an inner periphery on a rear side of the screw in an axial direction, wherein the mechanism portion includes:

a lead holder that includes a core gripping portion capable of gripping the rod-shaped cosmetic material, and is engaged with the sleeve so as to be synchronously rotatable and movable in the axial direction;

an ejection rod that is disposed inside the lead holder, including a rod-shaped portion that extends forward in the axial direction, and engaged with the lead holder so as to be synchronously rotatable and movable in the axial direction; and a propelling rod that has a male screw screwed to the female screw on an outer periphery thereof, and is engaged with the ejection rod so as to be synchronously rotatable and immovable in the axial direction, wherein the sleeve has an advancing limit reached by the lead holder of the mechanism portion fed out by a screwing action of the female screw and the male screw when the sleeve and the barrel are rotated relative to each other in a given direction, wherein when the lead holder of the mechanism portion reaches the advancing limit, the screw and the propelling rod are engaged with each other so as to be synchronously rotatable, and wherein when the sleeve and the barrel are further relatively rotated in the given direction, by making a protrusion provided inside the barrel abut against the slope to push the slope forward, the propelling rod and the ejection rod are fed out, and the rod-shaped portion of the ejection rod enters the core gripping portion of the lead holder.

2. The rod-shaped cosmetic material feeding container according to claim 1, wherein the screw further includes a spring portion that expands and contracts in the axial direction, and wherein the mechanism portion further includes a compression spring that is disposed between the lead holder and the ejection rod.

3. The rod-shaped cosmetic material feeding container according to claim 1, wherein a length of the ejection rod to be fed out is equal to or greater than a core gripping length in the axial direction of the core gripping portion of the lead holder when the protrusion of the barrel abuts against and moves from a start portion to an end portion of the slope.

4. The rod-shaped cosmetic material feeding container according to claim 2, wherein one or a plurality of the slopes are provided along a circumferential direction of the screw, and wherein when the abutment of the protrusion of the barrel with the slope exceeds an end portion of the slope, the protrusion of the barrel moves to a start portion of the slope, and the rod-shaped portion of the ejection rod retreats until exiting from the core gripping portion by an urging force of the compression spring.

5. A rod-shaped cosmetic material feeding container comprising:

a sleeve that is capable of accommodating a rod-shaped cosmetic material;

a barrel that is engaged with the sleeve so as to be rotatable relative to the sleeve;

a screw that is provided with a spring portion expanding and contracting in an axial direction, provided with a female screw on an inner periphery on a rear side of the screw in the axial direction of the spring portion, and disposed inside the barrel so as to be synchronously rotatable; and a mechanism portion that is accommodated inside the sleeve and the barrel and configured to feed out the rod-shaped cosmetic material, wherein the mechanism portion includes:

a lead holder that includes a core gripping portion that is capable of gripping the rod-shaped cosmetic material, and is engaged with the sleeve so as to be synchronously rotatable and movable in the axial direction;

an ejection rod that is disposed inside the lead holder, includes a rod-shaped portion that extends forward in the axial direction, and is engaged with the lead holder so as to be synchronously rotatable and movable in the axial direction;

a propelling rod that includes a male screw screwed to the female screw on an outer periphery thereof, and is engaged with the ejection rod so as to be synchronously rotatable and immovable in the axial direction; and a compression spring that is disposed between the lead holder and the ejection rod, wherein an advancing limit is provided in the sleeve and reached by the lead holder of the mechanism portion fed out by a screwing action of the female screw and the male screw when the sleeve and the barrel are rotated relative to each other, wherein an engaging portion is provided on the propelling rod and configured to be engaged with the screw so as to be synchronously rotatable when the lead holder reaches the advancing limit, wherein a slope is provided at a rear portion of the screw, against which a protrusion provided inside the barrel abuts, and is pushed forward while compressing the spring portion when the sleeve and the barrel are further relatively rotated in the same direction in a state where the engaging portion of the propelling rod is engaged with the screw so as to be synchronously rotatable, and wherein by pushing the slope, the propelling rod and the ejection rod are fed out while compressing the compression spring, and the rod-shaped portion of the ejection rod enters the core gripping portion of the lead holder.

6. The rod-shaped cosmetic material feeding container according to claim 5, wherein a length of the ejection rod to be fed out is equal to or greater than a core gripping length in the axial direction of the core gripping portion of the lead holder when the protrusion of the barrel abuts against and moves from a start portion to an end portion of the slope.

7. The rod-shaped cosmetic material feeding container according to claim 5, wherein one or a plurality of the slopes are provided along a circumferential direction of the screw, and wherein when the abutment of the protrusion of the barrel with the slope exceeds an end portion of the slope, the protrusion of the barrel moves to a start portion of the slope, and the rod-shaped portion of the ejection rod retreats until exiting from the core gripping portion by an urging force of the compression spring.

* * * * *